US007716864B2

(12) United States Patent
Skrubis et al.

(10) Patent No.: US 7,716,864 B2
(45) Date of Patent: May 18, 2010

(54) MOLDED RIFLE STOCK

(75) Inventors: Steven B. Skrubis, Granby, CT (US); Richard A. Picard, Ludlow, MA (US)

(73) Assignee: Smith & Wesson Corp., Springfield, MA (US)

( * ) Notice: Subject to any disclaimer, the term of this patent is extended or adjusted under 35 U.S.C. 154(b) by 112 days.

(21) Appl. No.: 11/971,956

(22) Filed: Jan. 10, 2008

(65) Prior Publication Data

US 2008/0244951 A1 Oct. 9, 2008

Related U.S. Application Data

(60) Provisional application No. 60/884,282, filed on Jan. 10, 2007, provisional application No. 60/943,363, filed on Jun. 12, 2007.

(51) Int. Cl.
*F41C 23/00* (2006.01)

(52) U.S. Cl. ..... 42/71.01; 42/85; D22/103

(58) Field of Classification Search ..... 42/71.01, 42/85, 75.1, 72, 73, 74; 224/150; D22/103, D22/108

See application file for complete search history.

(56) References Cited

U.S. PATENT DOCUMENTS 4,112,605 A * 9/1978 Staub ..... 42/1.06
6,070,354 A * 6/2000 Burigana et al. ..... 42/71.01
6,256,921 B1 * 7/2001 Howard et al. ..... 42/71.01

* cited by examiner

*Primary Examiner*—Michael Carone
*Assistant Examiner*—Daniel J Troy
(74) *Attorney, Agent, or Firm*—McCormick, Paulding & Huber LLP

(57) ABSTRACT

A molded firearm stock is disclosed. The stock includes a molded front sling lug and a molded rear sling lug. Both sling lugs are integrally molded to the stock and accommodate the fastening of a sling. The stock also includes a cavity with an open end that is open to a butt-plate of the stock. The cavity is integrally molded to the stock and is sized to accommodate a recoil-reducing device. The stock has a bed portion with a forward section, and a plurality of crossbeams are in the forward section to provide increased strength and rigidity.

17 Claims, 5 Drawing Sheets

MOLDED RIFLE STOCK

CROSS REFERENCE TO RELATED APPLICATIONS

This application claims the benefit of U.S. Provisional Application Ser. No. 60/884,282, filed on Jan. 10, 2007 and U.S. Provisional Application Ser. No. 60/943,363 filed on Jun. 12, 2007, herein incorporated by reference in their entirety.

FIELD OF THE INVENTION

The present invention relates generally to firearms with a molded stock. The present invention relates more specifically to a molded rifle stock with a molded sling lug and a recoil-reducing cavity. The present invention also relates more specifically to a molded rifle stock bed featuring x-shaped crossbeams that provide increased strength, rigidity and performance.

BACKGROUND OF THE INVENTION

Modern rifles are known to have synthetic stocks that are typically manufactured from injection-molded plastic or a molded fiberglass. As will be appreciated, it is important that such stocks be sufficiently strong and rigid to remain straight when being removed from a mold. Moreover, stock strength and rigidity are important during the cooling of such stocks after removal from the mold. The minimization of bending and drooping during the manufacturing process results in greater consistency of stocks, less waste, and reduced manufacturing and assembly costs.

In addition to strength and rigidity, it is also important that molded rifle stocks be relatively lightweight and well balanced to maximize performance of the rifle. Known molded stocks are typically either solid plastic or feature side-to-side ribbing. Such stocks do not, however, address the above-discussed issues to the extent possible.

Furthermore, rifle slings are often used in conjunction with a rifle stock. Rifle slings are typically secured to an eyelet hole extending from the bottom surface of a rifle stock. Alternatively, slings are attached via a fastener that is drilled into the stock. In either case, additional fabrication steps, such as drilling the stock, are required. Furthermore, additional components, such as an eyelet and fastener, are also required.

Moreover, some firearms such as shotguns have a center bolt cavity to attach the stock, typically made from wood, to the metal receiver of the shotgun. Such cavities are just large enough to accommodate the bolt and the tool used to attach the stock to the receiver. Rifle stocks generally, however, do not include chambers or cavities that can accommodate a center bolt as the receiver is mounted directly into the bed of a unitary stock.

Consequently, a fabricated cavity within the hollow section of a molded rifle stock would, in the past, have been of little interest. Accordingly, there are no rifles with molded stocks having a cavity that can accommodate a recoil-reducing device. Such devices are important and desirable, however, to reduce the forces generated upon discharge of a rifle.

As such there exists a need for a rifle stock with improved strength and rigidity that is lightweight and well balanced. There also exists a need for a molded rifle stock with an integrally molded sling lug and a cavity for a recoil-reducer. The present invention fulfills these needs and more.

SUMMARY OF THE INVENTION

It is an object of the present invention to provide a molded firearm stock with an integrated sling lug.

It is an additional object of the present invention to provide a molded firearm stock with a recoil-reducing cavity.

It is yet another object of the present invention to provide a molded rifle stock with an integrated sling lug.

It is an additional object of the present invention to provide a molded rifle stock with a recoil-reducing cavity.

It is another object of the present invention to provide a molded firearm stock bed.

It is another object of the present to provide a molded firearm stock bed that features increased strength and rigidity.

It is another object of the present invention to provide a molded firearm stock bed that features increased strength and rigidity through the use of multiple crossbeams.

It is another object of the present invention to provide a molded firearm stock bed that is relatively lightweight and well balanced to maximize performance.

It is another object of the present invention to provide a molded firearm stock bed that is lightweight and well balanced to maximize firearm performance through the use of multiple crossbeams.

According to one embodiment of the present invention, a unitary stock, adapted to receive a firearm having a receiver with a breech for receiving a cartridge for feeding into a barrel having a central bore and a bore axis with the receiver being attached to a trigger assembly, has a front portion adapted to receive a portion of the barrel, a middle portion adapted to receive the receiver, and a rear portion having an interior cavity that is selectively positioned along a longitudinal axis of the rear portion. The cavity has a major axis that is selectively positioned at an angle relative to the bore axis.

According to another embodiment of the present invention, a unitary stock, adapted to receive a firearm having a receiver with a breech for receiving a cartridge for feeding into a barrel having a central bore and a bore axis with the receiver being attached to a trigger assembly has a forward section adapted to receiver a portion of the barrel, a middle section adapted to receive the receiver, a rear section, and a plurality of crossbeams in the forward section.

According to yet another embodiment of the present invention, a unitary stock, adapted to receive a firearm having a receiver with a breech for receiving a cartridge for feeding into a barrel having a central bore and a bore axis with the receiver being attached to a trigger assembly has a forward section adapted to receiver a portion of the barrel, a middle section adapted to receive the receiver, a rear section having an interior cavity that is selectively positioned along a longitudinal axis of the rear portion, and a plurality of crossbeams in the forward section. The cavity has a major axis that is selectively positioned at an angle relative to the bore axis.

These and other objects of the present invention, and their preferred embodiments, shall become clear by consideration of the specification and drawings taken as a whole.

DETAILED DESCRIPTION OF THE PREFERRED EMBODIMENT

Figure 1:
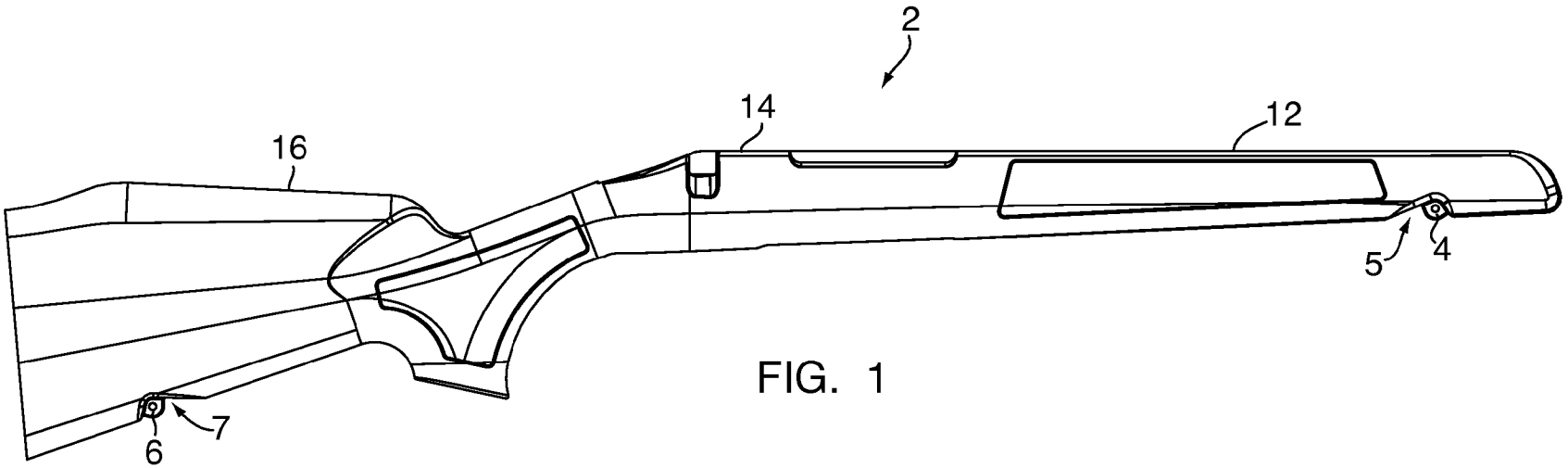
FIG. 1 is a side of an embodiment of a molded firearm stock of the present invention.

FIG. 1 depicts a side view of a molded firearm stock 2 made in accordance with an embodiment of the present invention. The stock 2 has a molded front sling lug 4 and a molded rear sling lug 6. The lugs 4 and 6 have an o-shaped opening to accommodate the fastening of a sling (not shown) to the molded firearm stock 2. To attach a sling, a user simply clips the sling via a removable fastener to the o-shaped openings in the molded front sling lug 4 and the molded rear sling lug 6. The lugs 4 and 6 also have clearance portions 5 and 7 molded into the stock 2 adjacent the lugs 4 and 6 to facilitate movement of the sling and sling fastener. The clearance portions 5 and 7 are recesses in the stock 2. By locating the lugs 4 and 6 in the clearance portions 5 and 7, the lugs 4 and 6 do not extend substantially beyond the outer contours of the stock 2.

The molded lugs 4 and 6 are an important aspect of the present invention since the stock 2 does not have to be drilled to accommodate lugs. Rather, the lugs 4 and 6 are integral to the stock 2. Moreover, fewer components are used in the fabrication process since eyelet holes are unnecessary. As such, the molded lugs 4 and 6 streamline the manufacturing process and conserve resources.

Figure 2:
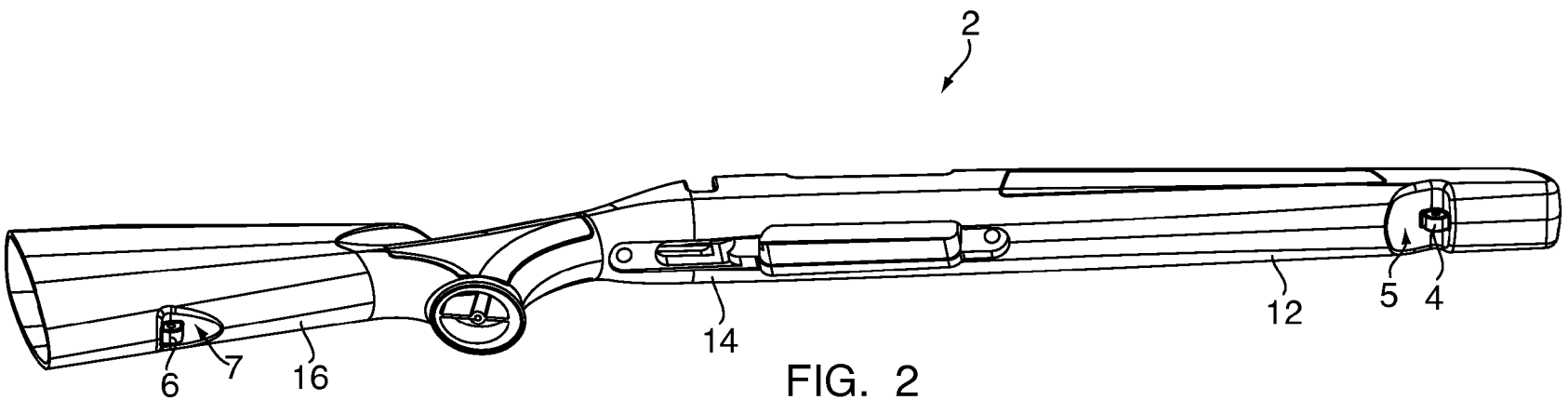
FIG. 2 is a perspective view of the molded firearm stock of FIG. 1.

FIG. 2 provides another perspective of the molded firearm stock 2. This perspective provides a better view of the clearance portions 5 and 7 surrounding the molded lugs 4 and 6. As described above, this configuration facilitates the movement of the sling and sling fastener.

Figure 3:
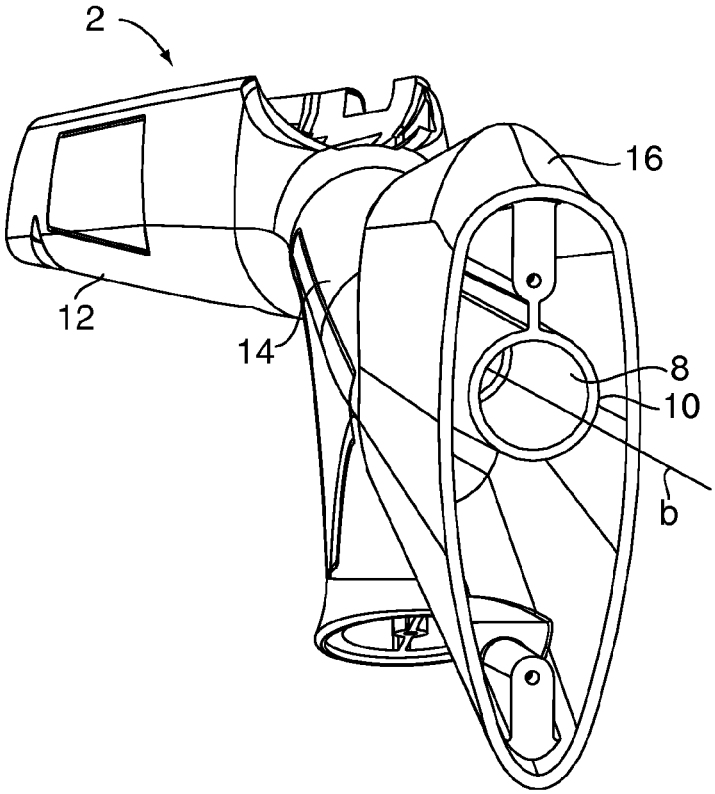
FIG. 3 is a rear perspective view of the molded firearm stock of FIG. 1.

Referring now to FIG. 3, an embodiment of the stock 2 of the present invention also includes an integrally molded recoil-reducing cavity 8. Preferably, the cavity 8 has an end 10 that is open to the butt-plate. The cavity 8 is sized to accommodate a variety of conventional recoil-reducing devices without further fabrication. For example, such devices include mercury-charged recoil suppressors. As will be appreciated, the recoil-reducing devices may be inserted into the cavity 8 through the open end 10.

Figure 4:
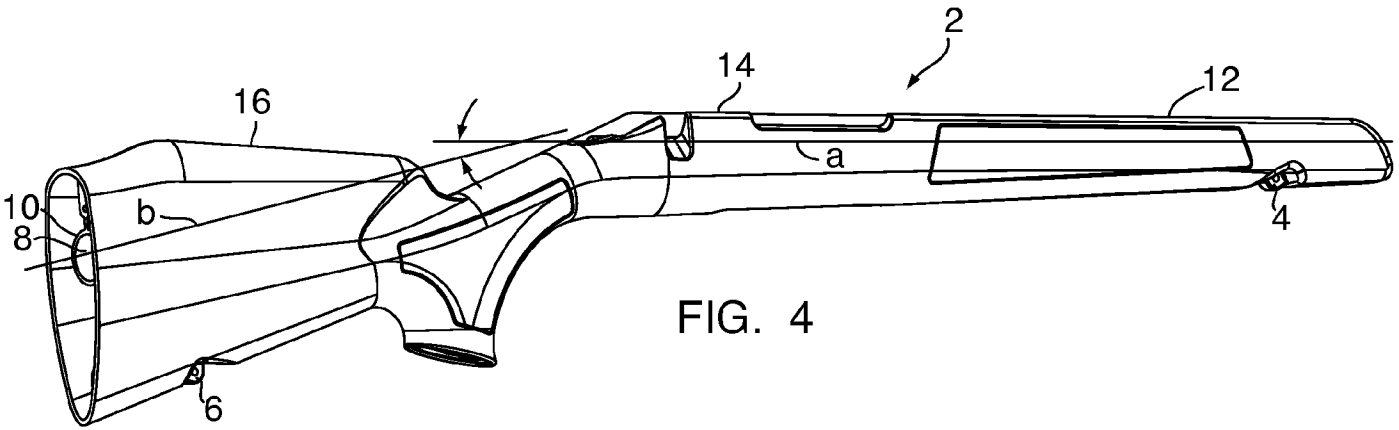
FIG. 4 is an additional perspective view of the molded firearm stock of FIG. 1.

FIG. 4 illustrates another perspective of the stock 2. The stock 2 consists of three sections. A forward section 12, relative to the front of the firearm, is beneath and partially encompasses the barrel (not shown). Before the forward section 12 is the middle portion 14, which accommodates the receiver and the trigger assembly of the firearm. The remainder of the stock 2 is the rear portion 16. The effectiveness of the recoil-reducing device is dependent in part on the angle of the cavity 8 and the vertical distance from the longitudinal axis a of the barrel. Additionally, the position of the recoil-reducing device relative to the balance point of the gun may also be a consideration. In the present invention, the cavity 8 is configured to have a geometric location and shape to ensure that the optimum recoil-reducing properties of the device are achieved. This configuration is illustrated in FIG. 4 with the axis of the cavity 8 designated as b.

As will be readily appreciated, the cavity 8 is an important aspect of the present invention. Conventional rifle stocks do not include cavities that accommodate recoil-reducing devices. Such devices are important and desirable to reduce recoil generated upon discharge of a rifle.

As discussed previously, shotguns have a center bolt cavity, which provides a place for a draw bolt to attach the receiver to the wooden stock. The cavity is configured to reduce forces and to prevent cracks in the stock from strain. In other words, the purpose of the cavity is to protect the shotgun.

In stark contrast, rifle stocks do not require a center bolt, and therefore a center bolt cavity, since the receiver is mounted directly into the bed of a unitary stock. Thus, it is heretofore unknown to include a cavity in a rifle stock since it requires extra geometry considerations as well as additional assembly and manufacturing time. The purpose of the cavity in the present invention is not to protect the firearm as with shotguns; its purpose is to protect the operator by reducing the recoil of the firearm.

Figure 5:
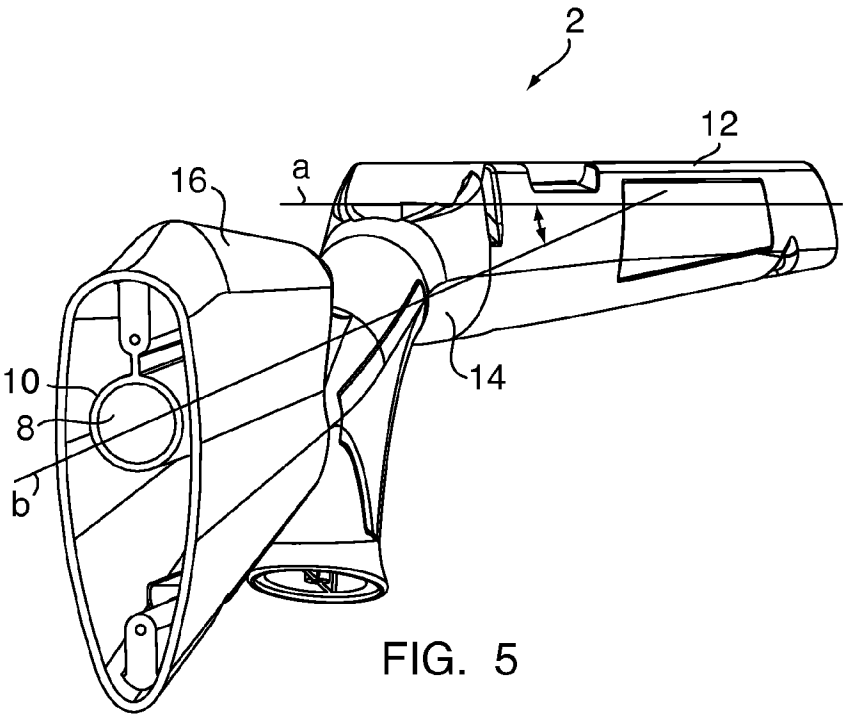
FIG. 5 is another rear perspective view of the molded firearm stock of FIG. 1.
Figure 6:
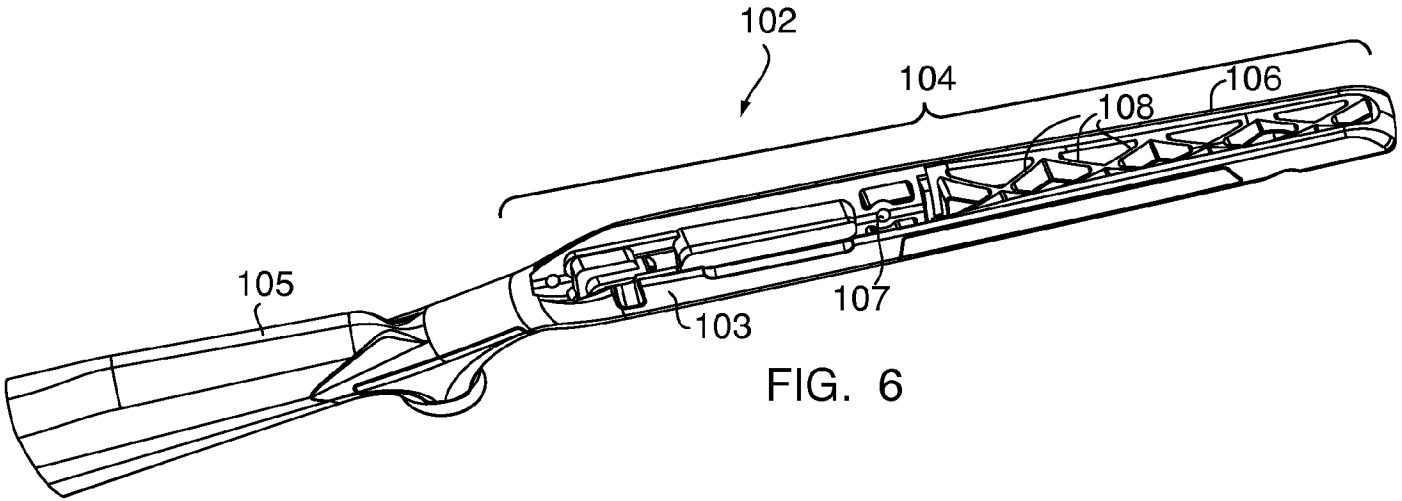
FIG. 6 is a perspective side view of a molded firearm stock bed according to an embodiment of the present invention.

FIG. 5 illustrates another view of the stock 2. A recoil-reducing device may be inserted through the open end 10. As discussed above, the effectiveness of the recoil-reducing device can be configured based on the angle of the cavity 8, as shown by axis b, and the vertical distance from the longitudinal axis a of the barrel. The angle between the intersection of axis a and axis b can be configured for optimum recoil-reducing properties as well as proper balance of the firearm. The cavity 8 may also be selectively positioned longitudinally within the rear portion 16 to achieve the best handling for the firearm.

As described above and shown in FIGS. 1-5, the present invention provides a molded firearm stock with a molded sling lug and a recoil-reducing cavity. By including an integrated sling lug in the stock, additional components and fabrication steps are not needed, which reduces both cost and assembly time. The recoil-reducing cavity in the stock is desirable to reduce the forces generated upon discharge of the firearm. Thus, the present invention provides several advantages, which have been heretofore unknown in the art.

Figure 7:
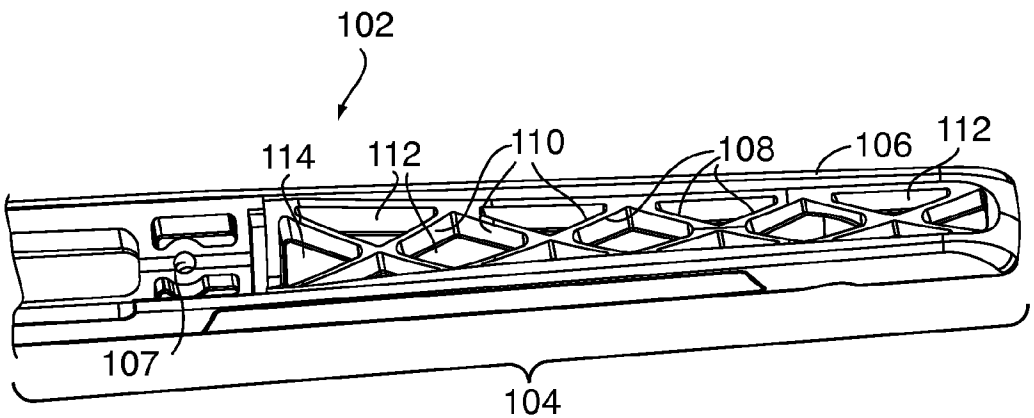
FIG. 7 is an enlarged perspective view of the molded firearm stock bed of FIG. 6.

FIGS. 6-10 depict a molded firearm stock 102 made in accordance with an embodiment of the present invention. As shown, the stock 102 has a bed portion 104, which, as will be appreciated, receives the barrel and action of the firearm (not shown). The bed 104 has a forward section 106, relative to the front of the firearm, that is beneath the barrel (not shown) and also partially encompasses the barrel. The forward section 106 of the bed 104 also features a plurality of crossbeams 108. Before the forward section 106 of the bed 104 is the middle portion 103, which accommodates the receiver and the trigger assembly of the firearm. The remainder of the stock 102 is the rear portion 105. As shown in FIG. 7, the stock 102 also includes an aperture 107 for an attachment means to secure the barrel of the firearm to the stock 102.

The crossbeams 108 are an important aspect of the present invention as they provide rigidity and stability to the stock 102 during the manufacturing process. The crossbeams 108 provide strength and rigidity so that the stock 102 remains straight when being removed from a mold. Moreover, stock strength and rigidity are important during cooling of the stock 102 after it is removed from the mold. As a result of the increased strength and rigidity provided by the crossbeams 108, bending and distortion of the stock is minimized during the manufacturing process. The minimization of the bending and distortion of the stock of the present invention results in greater consistency of stocks, less waste of materials, and reduced manufacturing and assembly costs. The lack of distortion also allows the bed 104 to be straight, which reduces exertion and strain on the barrel of the firearm.

Figure 8:
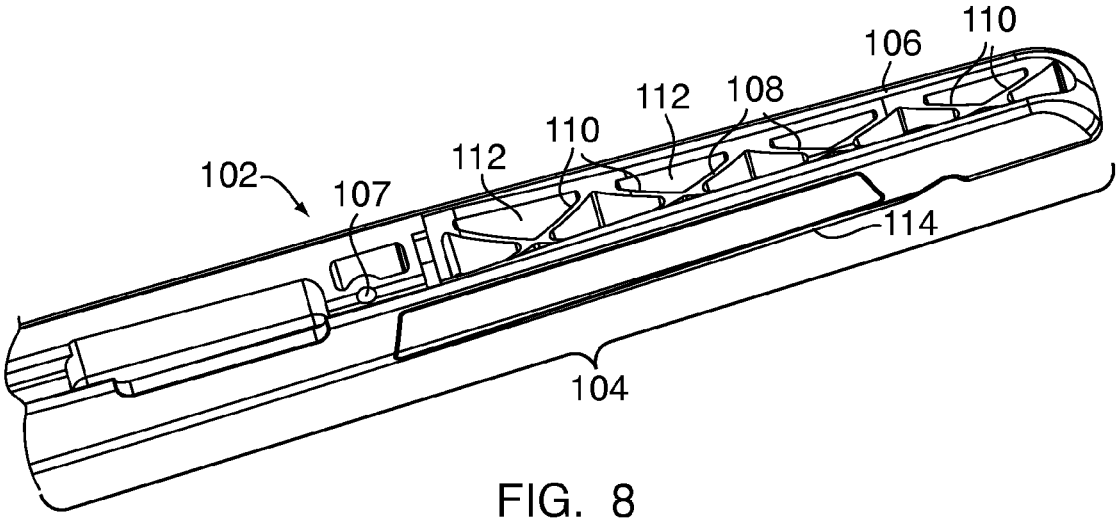
FIG. 8 is an enlarged perspective top view of the molded firearm stock bed of FIG. 6.
Figure 9:
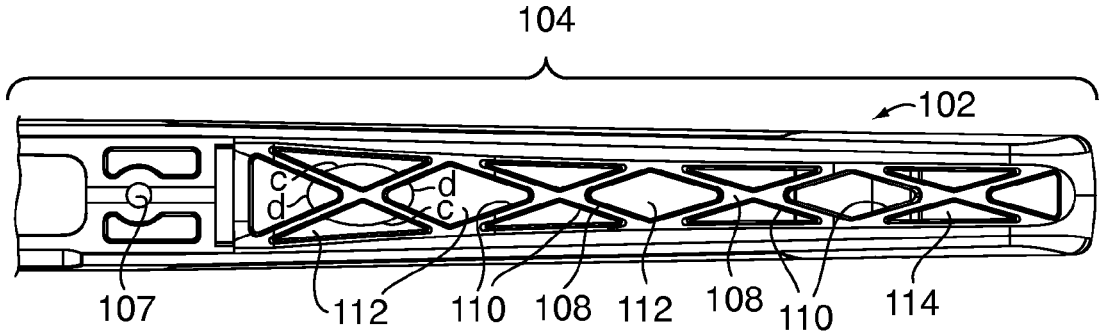
FIG. 9 is an enlarged top view of the molded firearm stock bed of FIG. 6.

As depicted more clearly in FIGS. 7-9, the crossbeams 108 are X-shaped and have abutting leg portions 110. In the depicted embodiment, the forward section 106 contains four crossbeams 108. Between the crossbeams 108 are molded voids 112 that are bounded by the underside 114 of the molded stock 102. While the figures depict abutting leg portions 110, it will be apparent that the leg portions 110, and the crossbeams 108, need not be in abutment as long as they provide sufficient rigidity and stability.

The X-shape of the crossbeams 108 is another important aspect of the present invention. As will be appreciated, it is important that molded rifle stocks be relatively lightweight and well balanced to maximize performance of the rifle. As shown best in FIG. 9, each crossbeam 108 has two obtuse angles c and two acute angles d. However, as will be readily appreciated, the angles of the crossbeams 108 could all be equal.

Figure 10:
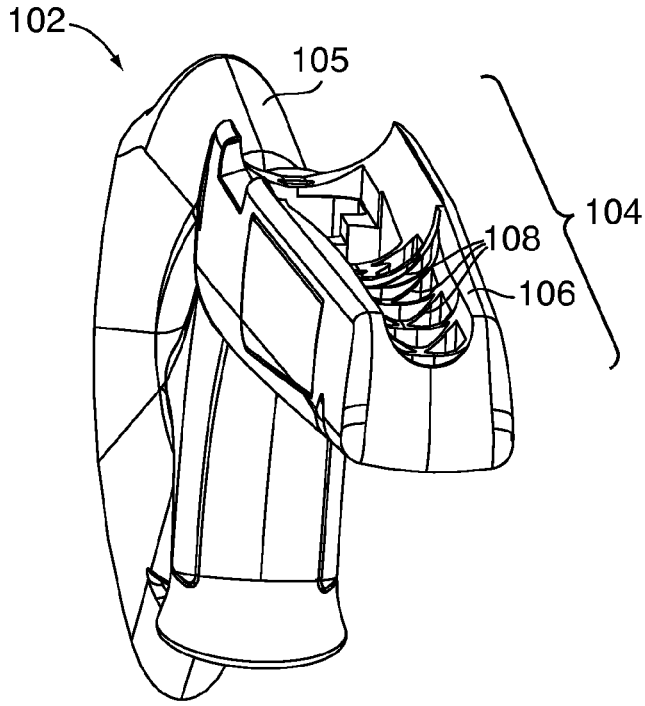
FIG. 10 is a front perspective view of the molded firearm stock bed of FIG. 6.

Turning now to FIG. 10, the top or upper surface of the crossbeams 108 are also curved or contoured so that the bed 104 is substantially U-shaped. As will be readily appreciated, the U-shaped configuration of the bed 104 accommodates the underside of a firearm barrel (not shown).

In sum, the inventive bed with its X-shaped crossbeams provides a stock with increased rigidity and strength, which ensures a consistent product and saves manufacturing costs. The present invention also provides a molded stock of lightweight and optimal balance to maximize firearm performance.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed but that the invention includes all embodiments falling within the scope of the appended claims.

What is claimed is:

1. A unitary stock comprising:

a front portion adapted to receive a portion of a barrel;

a middle portion integrally formed with said front portion and adapted to receive a receiver;

a rear portion integrally formed with said middle and front portions and having an interior cavity that is selectively positioned along a longitudinal axis of said rear portion;

a molded front clearance portion forming a recess in said front portion of said stock;

a molded rear clearance portion forming a recess in said rear portion of said stock;

a molded front sling lug formed within said front clearance portion, said front sling lug being integral to said stock and configured to not extend substantially beyond said front clearance portion;

a molded rear sling lug formed within said rear clearance portion, said rear sling lug being integral to said stock and configured to not extend substantially beyond said rear clearance portion; and wherein said front sling lug and said rear sling lug accommodates the fastening of a sling.

2. The unitary stock of claim 1, wherein said unitary stock is a molded firearm stock.

3. The unitary stock of claim 1, wherein said unitary stock is a molded rifle stock.

4. The unitary stock of claim 1, wherein said cavity is generally cylindrical.

5. The unitary stock of claim 1, wherein said cavity is integrally molded to said stock.

6. The unitary stock of claim 1, wherein said front sling lug and said rear sling lug have an o-shaped opening.

7. A unitary stock having a bore axis extending along a longitudinal axis of said unitary stock comprising:

a forward section adapted to receive a portion of a barrel;

a middle section integrally formed with said forward section and adapted to receive a receiver;

a rear section integrally formed with said middle section and said forward section and having an interior cavity;

a plurality of X-shaped crossbeams integrally formed in said forward section, said crossbeams defining a plurality of open areas encompassing said longitudinal axis;

a molded front clearance portion defining a recess in said front section of said stock;

a molded rear clearance portion defining a recess in said rear section of said stock;

a molded front sling lug formed within said front clearance portion, said front sling lug being integral to said stock and configured to not extend substantially beyond said front clearance portion;

a molded rear sling lug formed within said rear clearance portion, said rear sling lug being integral to said stock and configured to not extend substantially beyond said rear clearance portion; and wherein said front sling lug and said rear sling lug accommodates the fastening of a sling.

8. The unitary stock of claim 7, wherein said unitary stock is a molded firearm stock.

9. The unitary stock of claim 7, wherein said unitary stock is a molded rifle stock.

10. The unitary stock of claim 7, wherein said cavity is generally cylindrical.

11. The unitary stock of claim 7, wherein said cavity is integrally molded to said stock.

12. The unitary stock of claim 7, wherein said front sling lug and said rear sling lug have an o-shaped opening.

13. The unitary stock of claim 7, wherein said crossbeams have leg portions and said leg portions are in abutment.

14. The unitary stock of claim 7, wherein said forward section has four crossbeams.

15. The unitary stock of claim 7, wherein the top surface of said crossbeams is contoured to be substantially U-shaped.

16. The unitary stock of claim 7, wherein said crossbeams have two obtuse angles and two acute angles.

17. The unitary stock of claim 7, wherein said crossbeams have four equal angles.

* * * * *